United States Patent [19]

Pottebaum

[11] Patent Number: 4,984,981

[45] Date of Patent: Jan. 15, 1991

[54] HEATER WITH FLAME POWERED LOGIC SUPPLY CIRCUIT

[75] Inventor: Joseph R. Pottebaum, Brookfield, Wis.

[73] Assignee: A. O. Smith Corporation, Milwaukee, Wis.

[21] Appl. No.: 360,271

[22] Filed: Jun. 2, 1989

[51] Int. Cl.[5] ..... F23N 5/10

[52] U.S. Cl. ..... 431/80; 431/18; 431/42; 320/21; 320/61; 136/217

[58] Field of Search ..... 431/18, 80, 42; 320/21, 320/61; 136/217, 220; 340/577

[56] References Cited

U.S. PATENT DOCUMENTS

| | | | |
|---|---|---|---|
| 3,820,939 | 6/1974 | McKenna | 431/79 |
| 3,992,137 | 11/1976 | Streisel . | |
| 4,236,107 | 11/1980 | Templin | 320/21 |
| 4,770,629 | 9/1988 | Bohan, Jr. | 431/80 X |
| 4,778,378 | 10/1988 | Dolnick et al. | 431/46 X |
| 4,793,799 | 12/1988 | Goldstein et al. | 431/79 |
| 4,847,546 | 7/1989 | Bobier et al. | 320/21 |
| 4,862,013 | 8/1989 | Koncopka | 320/21 |

FOREIGN PATENT DOCUMENTS

| | | | |
|---|---|---|---|
| 0026923 | 7/1981 | Japan | 431/80 |
| 0080632 | 2/1983 | Japan | 431/80 |
| 0214714 | 12/1983 | Japan | 431/75 |

*Primary Examiner*—Carl D. Price

*Attorney, Agent, or Firm*—Andrus, Sceales, Starke & Sawall

[57] ABSTRACT

A flame powered logic supply circuit (60) responds to a pilot flame (39b) and supplies electrical energy to power electronic logic circuitry (62) for a heater, such as a hot water heater (1), a furnace, or the like. A thermoelectric element (64) responds to the flame and outputs electrical current which is stored in an inductor (70). A pair of parallel circuit branches (78 and 80) are connected to the thermoelectric element (64) and the inductor (70). The first branch (78) has a semiconductor switch (82) with an on state during which current flow supplies energy to the inductor (70) which is stored therein. The second circuit branch (80) has a second energy storage component provided by a battery (90) which receives the stored energy from the inductor (70) during an off state of the semiconductor switch (82) to charge the battery (90) and maintain a given power rating thereof for powering electronic logic circuitry (62) of the heater. Monitoring circuitry is provided by a current sensing resistor (74) and a comparator (96) controlling the semiconductor switch (82) between its on and off states. Circuits (60, 60a) may be provided for both the pilot flame (39b) and a main burner flame (10a), or only for one or the other. The circuits (60, 60a) include indicia (94, 94a) providing a display indicating that each respective flame is lit and that energy is being supplied therefrom for powering the logic circuitry (62).

20 Claims, 2 Drawing Sheets

HEATER WITH FLAME POWERED LOGIC SUPPLY CIRCUIT

BACKGROUND OF THE INVENTION

The invention relates to heater assemblies, such as gas fired water heaters, and more particularly to a flame powered logic supply circuit supplying electrical energy to power electronic logic circuitry for the heater and/or for indicia purposes.

A gas fired water heater has an inner storage tank for storing water to be heated, a main burner below the tank for heating the water in the tank, and a pilot for igniting the burner. The present invention provides particularly simple and effective circuitry responsive to the pilot flame and supplying electrical energy to power electronic logic circuitry for the water heater. The circuit enables the pilot flame to generate sufficient energy to drive electronic logic circuitry such as monitoring circuitry including LCDs (liquid crystal displays) for water temperature, time of day, set back time, flue gas temperature, etc. The supply circuit enables the pilot flame to be a stand alone power source, with or without a backup battery The invention has application to various other types of heater assemblies, such as furnaces, hydronic heaters, and so on.

In further embodiments, a second flame powered supply circuit is provided for the main burner, in addition to the flame powered supply circuit for the pilot. The supply circuits include indicia, such as LEDs (light emitting diodes) providing an indication that current is flowing therethrough and hence that the respective flame is lit.

In another implementation, a flame powered supply circuit is provided for the main burner and provides charging current for a battery which powers electronic logic circuitry for the heater. This implementation is particularly desirable in pilotless ignition systems where there may be long gaps of time between usage of the main burner.

DETAILED DESCRIPTION

Figure 1:
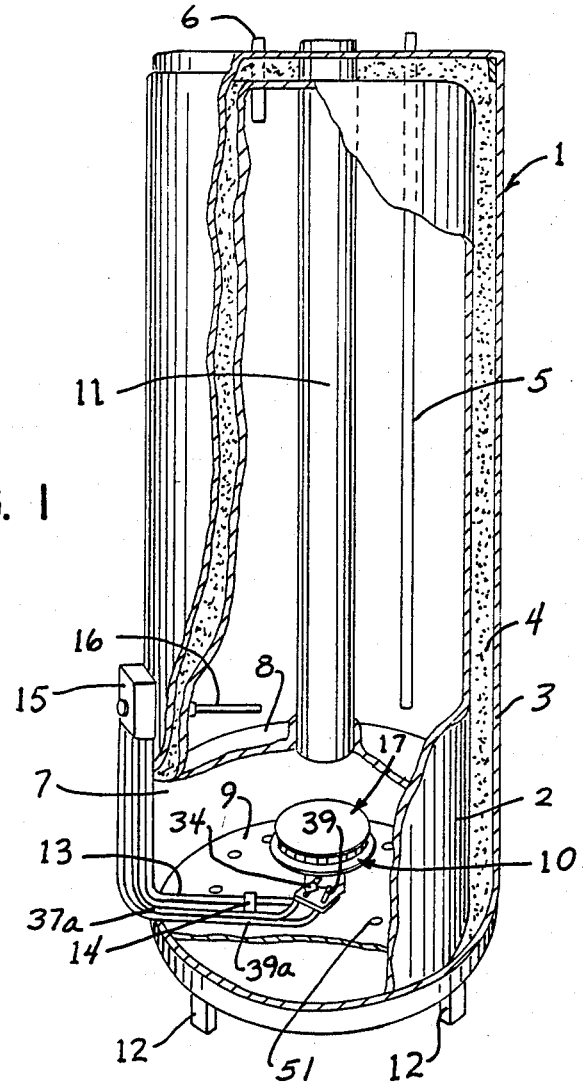
FIG. 1 is a perspective view of a gas fired water heater, with portions broken away.

FIG. 1 shows a gas fired water heater 1 and is taken from FIG. 1 of U.S. Pat. No. 3,992,137, incorporated herein by reference, and uses like reference numerals as said incorporated patent where appropriate to facilitate clarity. The water heater includes an inner storage tank 2 storing water to be heated. Tank 2 is enclosed by an outer casing 3 and a layer of insulation 4. Water is introduced into the tank through dip tube 5. Heated water is withdrawn from the tank through nipple 6. A combustion chamber 7 is located in the lower portion of the heater and is defined by a lower head 8 and a base 9. Base 9 is supported by legs 12. A gas main burner 10 including burner head 17 is located within combustion chamber 7 below tank 2 for heating the water in the tank. Combustion air to chamber 7 is supplied through openings 51 in base 9. The products of combustion are exhausted upwardly through flue 11. Gas is supplied to burner 10 through tube 13 which is supported above base 9 by a saddle 14. The other end of tube 13 is connected to gas shut-off valve mechanism 15 and interconnected thermostat 16, a portion of which is located on the outside of casing 3. Thermostat 16 is located within the bottom portion of tank 2 and is operatively connected to open and close the gas valve and regulate the flow of gas to main burner 10 in response to fluctuations in the water temperature. Gas is also supplied from gas shut-off mechanism 15 through tube **37*a* to pilot burner 34. Thermocouple unit 39 is connected by conduit 39*a* to mechanism 15** such that the pilot gas is shut-off in the absence of a pilot flame.

Figure 2:
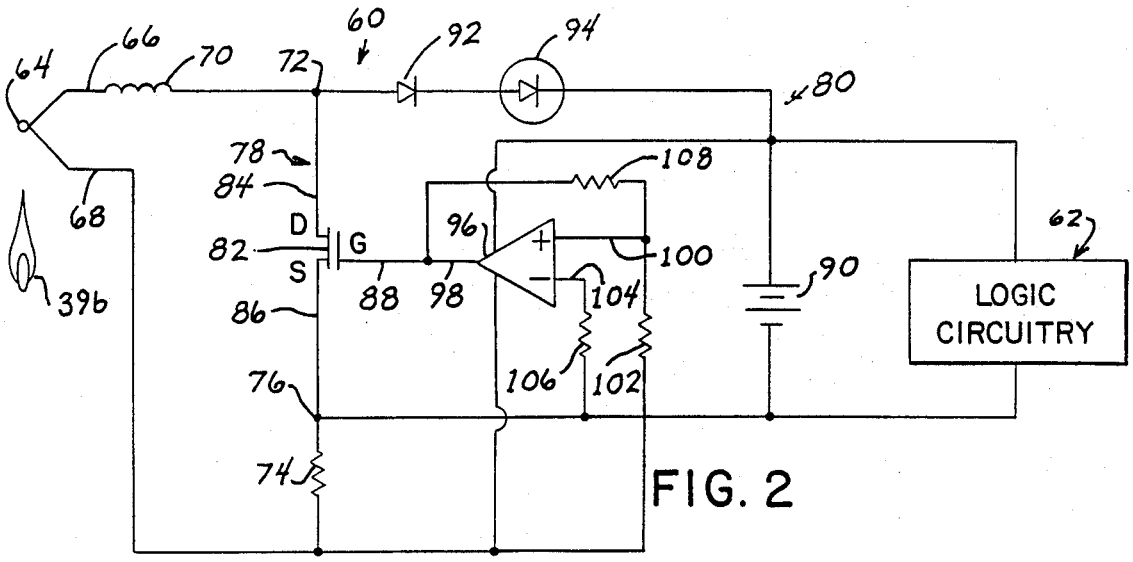
FIG. 2 is a circuit diagram of a flame powered logic supply circuit constructed in accordance with the invention.

FIG. 2 shows a flame powered logic supply circuit 60 in accordance with the invention. In the preferred embodiment, the circuit derives electrical power at 5 volts or greater directly from the pilot flame **39*b* of pilot burner 39. This voltage level is sufficient to power electronic logic circuitry 62** for the water heater, such as monitoring circuitry using LCDs for displaying water temperature, time of day, set back time, flue gas temperature, etc.

Circuit 60 includes a thermoelectric element 64 responsive to pilot flame **39*b* and outputting electrical current. In one embodiment, thermoelectric element 64 is an A.0. Smith Part No. 035489-002, capable of producing about 0.75 volts at about 100 milliamps. Thermoelectric element 64 has a first terminal 66 and a second terminal 68. An energy storage component is provided by inductor 70 connected in series between terminal 66 and a first node 72. A current flow sensor is provided by a current sensing resistor 74 connected in series between terminal 68 and a second node 76. Circuit 60 includes a pair of circuit branches 78 and 80 connected in parallel with each other between nodes 72 and 76. Circuit branch 78 includes a semiconductor switch such as FET (field effect transistor) 82 having a first main terminal such as drain terminal 84 connected to node 72, and a second main terminal such as source terminal 86 connected to node 76, and a control terminal such as gate terminal 88 for controlling conduction of switch 82 between an on state conducting current between nodes 72 and 76, and an off state blocking such current flow. The other circuit branch 80 includes an energy storage component such as provided by battery 90 connected in series between nodes 72 and 76. Circuit branch 80 also includes rectifying diode 92 and LED (light emitting diode) 94**.

Circuit 60 includes a comparator 96 having an output 98 connected to control terminal 88 of switch 82, and having a non-inverting input 100 connected through resistor 102 to one side of current sensing resistor 74 at terminal 68, and having an inverting input 104 connected through resistor 106 to the other side of resistor 74 at node 76.

In operation, flame powered logic supply circuit 60 responds to pilot flame **39*b* and supplies electrical energy to power electronic logic circuitry 62 for the water heater. During the on state of switch 82, current flows from thermoelectric element 64 through inductor 70 through switch 82 through resistor 74 back to thermoelectric element 64. This current flow supplies energy to inductor 70 which is stored therein. Comparator 96 and current flow sensor 74 monitor the energy stored in inductor 70. Comparator 96 senses the current flow through resistor 74 by sensing the voltage across the latter at comparator inputs 100 and 104. When the voltage at comparator input 104 rises above a first given level relative to the voltage at input 100, comparator output 98 goes low, which turns off switch 82. The low state at comparator output 98 is communicated through feedback connection resistor 108 to comparator input 100** to lower the switching threshold reference level thereat to a second lower switching level, to be described.

In the off state of switch 82, current flows from thermoelectric element 64 through inductor 70 through diode 92 through diode 94 through battery 90 through resistor 74 back to thermoelectric element 64. This current charges battery 90. The energy stored in inductor 70 during the previous on state of switch 82 is released and supplied to battery 90 to maintain a given power rating thereof for powering electronic logic circuitry 62 of the water heater. In one embodiment, battery 90 is a 7.2 volt nickel cadmium battery. The on state of switch 82 is substantially longer than its off state, to enable sufficient time to store enough energy in inductor 70 to acquire a voltage level sufficient to charge battery 90 during the off state of switch 82. Diode 92 is connected in series in circuit branch 80 in a direction aiding the noted charging current, and prevents discharge of battery 90 during the on state of switch 82. LED 94 responds to the noted charging current therethrough to provide a visual display that energy is being supplied to battery 90, and that pilot flame **39*b*** is lit.

When the voltage across current sensing resistor 74 decreases to a value such that the voltage at comparator input 104 drops below the above noted second lower switching threshold reference level at input 100, then comparator output 98 goes high. This high state turns on switch 82, such that circuit branch 78 becomes conductive again and current flows therethrough, rather than flowing through circuit branch 80 to battery 90. Energy is again supplied to inductor 70 and stored therein during the on state of switch 82, to continue the cycle. The high state at comparator output 98 is fed back through resistor 108 to comparator input 100 to raise the switching threshold reference level thereat to the noted higher first level. The difference between the first and second switching threshold reference levels at comparator input 100 is chosen to provide an on time of switch 82 substantially longer than the off time of switch 82.

Figure 3:
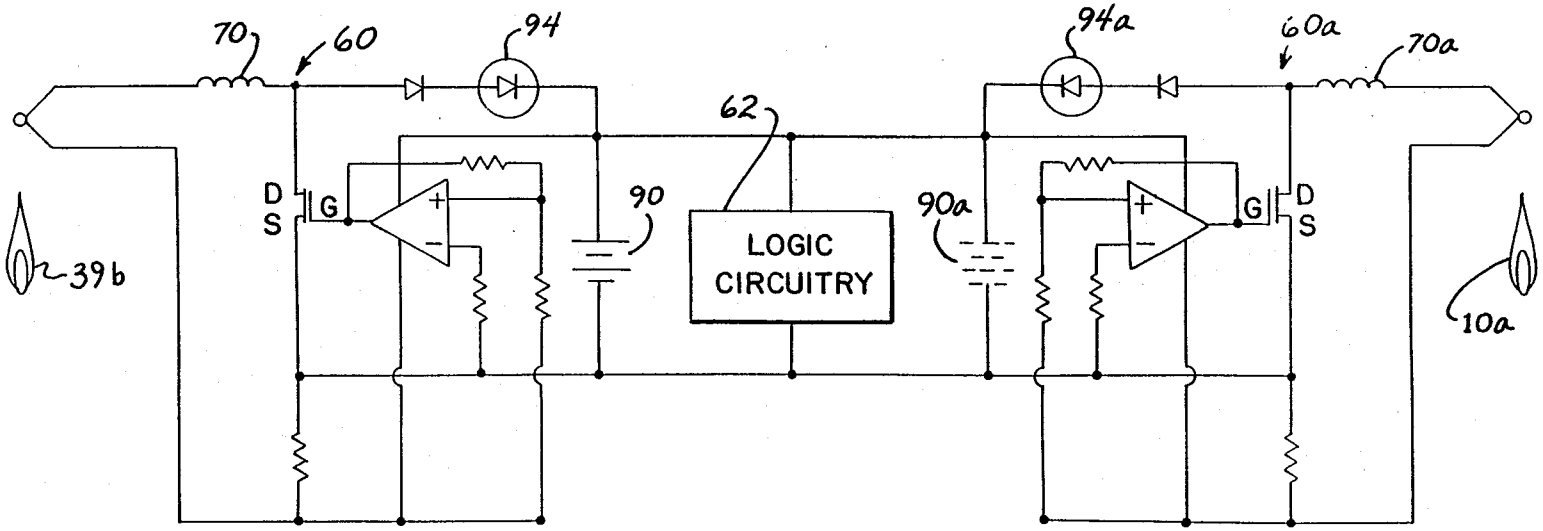
FIG. 3 is a circuit diagram showing another embodiment of the invention.

FIG. 3 shows a further embodiment wherein a second circuit **60*a* is provided, in addition to or in place of circuit 60. Circuit 60*a* is identical to circuit 60 and provides electrical power from main burner flame 10*a* and supplies same to battery 90 of circuit 60, or to its own battery as shown in dashed line at 90*a*. LEDs 94 and 94*a* provide indicia indicating that the respective pilot and burner flames 39*b* and 10*a*** are lit, and that energy is being supplied from the respective thermoelectric elements and inductors.

In FIG. 3, circuit 60 may be deleted in various implementations, for example where it is desired to supply energy only from main burner flame **10*a*, or in pilotless type ignition systems. In the latter, he use of a battery 90*a* as the storage component, rather than capacitors or the like, is particularly preferred in those implementations where there are long time intervals between uses of the burner, for example hot tubs, spas, and so on. Pilot type ignition systems are more amenable to substituting capacitors for battery 90 or 90*a*, because of the constant pilot flame available to supply energy for powering logic circuitry 62. In other alternatives, inductor 70 and/or 70*a*** is replaced or supplemented with another storage component, such as one or more capacitors.

It is recognized that various equivalents, alternatives and modifications are possible within the scope of the appended claims.

I claim:

1. In a heater assembly having a main burner intermittently ignited by a pilot flame, a flame powered logic supply circuit responsive to said pilot flame and supplying electrical energy to power electronic logic circuitry for the heater assembly, said supply circuit comprising a thermoelectric element responsive to said pilot flame and outputting electrical current, a first electrical energy storage component coupled to said thermoelectric element, a pair of parallel circuit branches coupled to said thermoelectric element and said storage component such that current flow through the first of said branches supplies current from said thermoelectric element to said storage component to supply energy thereto, the second of said circuit branches having a second energy storage component of a given power rating for powering said electronic logic circuitry of said heater assembly, one of said branches having a semiconductor switch with on and off states, monitoring circuitry monitoring the energy stored in said first storage component and controlling said semiconductor switch between said on and off states in response thereto, such that during one of said states current flows through said first branch including from said thermoelectric element to said first storage component to supply energy thereto, and such that during the other of said states current flows through said second circuit branch including from said first storage component to said second storage component to supply stored energy from said first storage component to said second storage component to maintain said given power rating of the latter.

2. The invention according to claim 1 wherein said second storage component comprises a battery, and said one state of said semiconductor switch is substantially longer than said other state of said semiconductor switch.

3. The invention according to claim 2 wherein said first storage component comprises an inductor connected in series between said thermoelectric element and a node common to both of said circuit branches.

4. In a heater assembly having a main burner intermittently ignited by a pilot flame, a flame powered logic supply circuit responsive to said pilot flame and supplying electrical energy to power electronic logic circuitry for the heater assembly, said supply circuit comprising:

a thermoelectric element responsive to said pilot flame and outputting electrical current;

a first electrical energy storage component coupled to said thermoelectric element;

a pair of parallel circuit branches coupled to said thermoelectric element and said storage component, the first of said circuit branches comprising a semiconductor switch having an on state completing a circuit therethrough from said thermoelectric element such that current flow through said last mentioned circuit supplies energy to said storage component which is stored therein, said semiconductor switch having an off state blocking current flow in said first circuit branch such that current from said thermoelectric element flows through the second of said circuit branches, said second circuit branch comprising a second energy storage component receiving current from said thermoelectric element and from said first storage component when said semiconductor switch is in said off state, to supply energy to said second storage component, including stored energy supplied from said first storage component to said second storage component, to maintain a given power rating of said second storage component for powering said electronic logic circuitry of said heater assembly;

monitoring circuitry monitoring the energy stored in said first storage component and controlling said semiconductor switch between said on and off states to release said stored energy from said first storage component to said second storage component during said off state of said semiconductor switch, and to re-supply energy to said first storage component during said on state of said semiconductor switch.

5. The invention according to claim 4 wherein said monitoring circuitry comprises a current flow sensor, and a comparator having an output connected to said semiconductor switch for controlling the conduction state thereof, and a pair of inputs connected to said current flow sensor, one of said inputs having a varying switching threshold reference level including a first higher level for actuating said semiconductor switch from said on to said off state, and a second lower level for actuating said semiconductor switch from said off to said on state.

6. The invention according to claim 5 wherein said current flow sensor comprises a resistor connected in series between said thermoelectric element and a node common to both of said circuit branches, said inputs of said comparator are connected to respective opposite ends of said resistor, such that during said on state of said semiconductor switch, current flows through said resistor and develops a voltage thereacross which is sensed by said comparator, and when the voltage at the other of said inputs of said comparator reaches said first level relative to said one input, said output of said comparator transitions to turn off said semiconductor switch, such that current flows through said second circuit branch including said second energy storage component and through said current sensing resistor, and when the voltage at said other input of said comparator reaches said second lower level relative to said one input of said comparator, said comparator output transitions to turn on said semiconductor switch.

7. In a heater assembly having a main burner intermittently ignited by a pilot flame, a flame powered logic supply circuit responsive to said pilot flame and supplying electrical energy to power electronic logic circuitry for the heater assembly, said supply circuit comprising:

a thermoelectric element responsive to said pilot flame and outputting electrical current, said thermoelectric element having first and second terminals;

an inductor connected in series between said first terminal of said thermoelectric element and a first node;

a current sensing resistor connected in series between said second terminal of said thermoelectric element and a second node;

a semiconductor switch connected in series between said first and second nodes, said switch having a first terminal connected to said first node, a second terminal connected to said second node, and a control terminal for controlling conduction of said semiconductor switch between an on state conducting current between said first and second terminals of said semiconductor switch, and an off state blocking current flow between said first and second terminals of said semiconductor switch;

a battery connected in series between said first and second nodes, and in parallel with said semiconductor switch;

a comparator having an output connected to said control terminal of said semiconductor switch, a first input connected to said second terminal of said thermoelectric element, a second input connected to said second node, and a feedback connection between said output of said comparator and one of said inputs of said comparator, such that during said on state of said semiconductor switch, current flows from said thermoelectric element through said inductor through said semiconductor switch through said current sensing resistor and back to said thermoelectric element, said inputs of said comparator sensing the voltage across said resistor such that when the voltage at the other of said inputs reaches a first given level relative to the voltage at said one input, said output of said comparator transitions to turn off said semiconductor switch, the output level of said comparator being communicated back through said feedback connection to said one input of said comparator to change the switching threshold reference level thereat, and such that during said off state of said semiconductor switch, current flows from said thermoelectric element through said inductor through said battery through said current sensing resistor back to said thermoelectric element to transfer stored energy from said inductor to said battery during said off state of said semiconductor switch, such that said battery is charged by said current and is also charged by the energy previously stored in said inductor during the above noted previous on state of said semiconductor switch, to maintain a given power rating of said battery for powering said electronic logic circuitry of said heater assembly, said inputs of said comparator sensing the voltage across said resistor during said off state of said semiconductor switch such that when the voltage at said other input reaches a second given level relative to the voltage at said one input, said output of said comparator transitions to turn on said semiconductor switch, the output level of said comparator output being communicated back through said feedback connection to said one input of said comparator to change the switching threshold reference level back to said first mentioned given level, for repetition of the cycle.

8. The invention according to claim 7 wherein the difference between said first and second given levels is chosen to provide a substantially longer on time of said semiconductor switch than off time of said semiconductor switch, to allow sufficient time to store enough energy in said inductor to supply charging current to said battery.

9. The invention according to claim 8 comprising a diode connected in series with said battery between said first and second nodes and blocking discharge current of said battery in a direction opposite said charging current.

10. The invention according to claim 9 comprising a second diode connected in series with said battery between said first and second nodes, said second diode being a light emitting diode connected in series aiding relation with said charging current through said battery to provide a visual indication of same.

11. In a heater assembly having a main burner intermittently ignited by a pilot flame, a first flame powered electric supply circuit responsive to said pilot flame and supplying electrical energy when said pilot flame is lit, said first circuit comprising a first thermoelectric element responsive to said pilot flame and outputting electrical current supplying electrical energy to power electronic logic circuitry for the heater assembly, a second flame powered electric supply circuit responsive to said main burner and supplying electrical energy when said main burner is lit, said second circuit comprising a second thermoelectric element responsive to said main burner and outputting electrical current supplying electrical energy to power said electronic logic circuitry for the heater assembly, a first indicia component in said first circuit having a first condition indicating that said pilot flame is lit, a second indicia component in said second circuit having a first condition indicating that said main burner is lit, such that said first and second indicia components provide a means of monitoring the conditions of both said pilot flame and said main burner.

12. The invention according to claim 11 comprising a battery coupled to each of said first and second circuits and charged by energy therefrom to maintain a given power rating of said battery for powering said electronic logic circuitry of said heater assembly.

13. The invention according to claim 12 wherein said first flame powered supply circuit comprises a first energy storage component connected to said first thermoelectric element, a first pair of parallel circuit branches connected to said first thermoelectric element and said first storage component, the first of said circuit branches of said first pair comprising a first semiconductor switch having an on state completing a circuit therethrough from said first thermoelectric element such that current flow in said first circuit branch of said first pair supplies energy to said first storage component which is stored therein, said first semiconductor switch having an off state blocking current flow in said first circuit branch of said first pair such that current from said first thermoelectric element flows through the second of said circuit branches of said first pair, said second circuit branch of said first pair including said battery receiving current from said first thermoelectric element and from said first storage component when said first semiconductor switch is in said off state, to supply energy to said battery to maintain said given power rating thereof for powering said electronic logic circuitry of said heater assembly, and first monitoring circuitry monitoring the energy stored in said first storage component and controlling said first semiconductor switch between said on and off states to release said stored energy from said first storage component to said battery during said off state of said first semiconductor switch, and to re-supply energy to said first storage component during said on state of said first semiconductor switch, and wherein said second flame power supply circuit comprises a second electrical energy storage component connected to said second thermoelectric element, a second pair of parallel circuit branches connected to said second thermoelectric element and said second storage component, the first of said circuit branches of said second pair including a second semiconductor switch having an on state completing a circuit therethrough from said second thermoelectric element such that current flow through said first circuit branch of said second pair supplies energy to said second storage component which is stored therein, said second semiconductor switch having an off state blocking current flow in said first circuit branch of said second pair such that current flow from said second thermoelectric element flows through the second of said circuit branches of said second pair, said second circuit branch of said second pair including said battery receiving current from said second thermoelectric element and from said second storage component when said second semiconductor switch is in said off state, to supply energy to said battery to maintain a given power rating of said battery for powering said electronic logic circuitry of said heater assembly, and second monitoring circuitry monitoring the energy stored in said second storage component and controlling said second semiconductor switch between said on and off states to release said stored energy from said second storage component to said battery during said off state of said second semiconductor switch, and to re-supply energy to said second storage component during said on state of said second semiconductor switch.

14. In a heater assembly having a main burner intermittently ignited by an ignition system, a flame powered logic supply circuit responsive to the main burner flame and supplying electrical energy to charge a battery to power electronic logic circuitry for the heater assembly, said supply circuit comprising:

a thermoelectric element responsive to said main burner flame and outputting electrical current;

an electrical energy storage component connected to said thermoelectric element;

a pair of parallel circuit branches connected to said thermoelectric element and said storage component, the first of said circuit branches including a semiconductor switch having an on state completing a circuit therethrough from said thermoelectric element such that current flow through said first circuit branch supplies energy to said storage component which is stored therein, said semiconductor switch having an off state blocking current flow in said first circuit branch such that current flow from said thermoelectric element flows through the second of said circuit branches, said second circuit branch including said battery receiving current from said thermoelectric element and from said storage component when said semiconductor switch is in said off state, to supply energy to said battery to maintain a given power rating thereof for powering said electronic logic circuitry of said heater assembly, monitoring circuitry monitoring the energy stored in said storage component and controlling said semiconductor switch between said on and off states to release said stored energy from said storage component to said battery during said off state of said semiconductor switch, and to re-supply energy to said storage component during said on state of said semiconductor switch.

15. The invention according to claim 14 wherein said monitoring circuitry comprises a current flow sensor, and a comparator having an output connected to said semiconductor switch for controlling the conduction state thereof, and a pair of inputs connected to said current flow sensor, one of said inputs having a varying switching threshold reference level including a first higher level for actuating said semiconductor switch from said on to said off state, and a second lower level for actuating said semiconductor switch from said off to said on state.

16. The invention according to claim 15 wherein said current flow sensor comprises a resistor connected in series between said thermoelectric element and a node common to both of said circuit branches, said inputs of said comparator are connected to respective opposite ends of said resistor, such that during said on state of said semiconductor switch, current flows through said resistor and develops a voltage thereacross which is sensed by said comparator, and when the voltage at the other of said inputs of said comparator reaches said first level relative to said one input, said output of said comparator transitions to turn off said semiconductor switch, such that current flows through said second circuit branch including said battery and through said current sensing resistor, and when the voltage at said other input of said comparator reaches said second lower level relative to said one input of said comparator, said comparator output transitions to turn on said semiconductor switch.

17. In a heater assembly having a main burner intermittently ignited by an ignition system, a flame powered logic supply circuit responsive to the main burner flame and supplying electrical energy to power electronic logic circuitry for the heater assembly, said supply circuit comprising:

a thermoelectric element responsive to said main burner flame and outputting electrical current, said thermoelectric element having first and second terminals;

an inductor connected in series between said first terminal of said thermoelectric element and a first node;

a current sensing resistor connected in series between said second terminal of said thermoelectric element and a second node;

a semiconductor switch connected in series between said first and second nodes, said switch having a first terminal connected to said first node, a second terminal connected to said second node, and a control terminal for controlling conduction of said semiconductor switch between an on state conducting current between said first and second terminals of said semiconductor switch, and an off state blocking current flow between said first and second terminals of said semiconductor switch;

a battery connected in series between said first and second nodes, and in parallel with said semiconductor switch;

a comparator having an output connected to said control terminal of said semiconductor switch, a first input connected to said second terminal of said thermoelectric element, a second input connected to said second node, and a feedback connection between said output of said comparator and one of said inputs of said comparator, such that during said on state of said semiconductor switch, current flows from said thermoelectric element through said inductor through said semiconductor switch through said current sensing resistor and back to said thermoelectric element, said inputs of said comparator sensing the voltage across said resistor such that when the voltage at the other of said inputs reaches a first given level relative to the voltage at said one input, said output of said comparator transitions to turn off said semiconductor switch, the output level of said comparator being communicated back through said feedback connection to said one input of said comparator to change the switching threshold reference level thereat, and such that during said off state of said semiconductor switch, current flows from said thermoelectric element through said inductor through said battery through said current sensing resistor back to said thermoelectric element to transfer stored energy from said inductor to said battery during said off state of said semiconductor switch, such that said battery is charged by said current and is also charged by the energy previously stored in said inductor during the above noted previous on state of said semiconductor switch, to maintain a given power rating of said battery for powering said electronic logic circuitry of said heater assembly, said inputs of said comparator sensing the voltage across said resistor during said off state of said semiconductor switch such that when the voltage at said other input reaches a second given level relative to the voltage at said one input, said output of said comparator transitions to turn on said semiconductor switch, the output level of said comparator output being communicated back through said feedback connection to said one input of said comparator to change the switching threshold reference level back to said first mentioned given level, for repetition of the cycle.

18. The invention according to claim 17 wherein the difference between said first and second given levels is chosen to provide a substantially longer on time of said semiconductor switch than off time of said semiconductor switch, to allow sufficient time to store enough energy in said inductor to supply charging current to said battery.

19. The invention according to claim 18 comprising a diode connected in series with said battery between said first and second nodes and blocking discharge current of said battery in a direction opposite said charging current.

20. The invention according to claim 19 comprising a second diode connected in series with said battery between said first and second nodes, said second diode being a light emitting diode connected in series aiding relation with said charging current through said battery to provide a visual indication of same.

* * * * *